US009941060B2

(12) United States Patent
Bendel

(10) Patent No.: US 9,941,060 B2
(45) Date of Patent: Apr. 10, 2018

(54) MICROSWITCH FOR POSITION DETERMINATION, AND USE

(71) Applicant: KIEKERT AG, Heiligenhaus (DE)

(72) Inventor: Thorsten Bendel, Oberhausen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 163 days.

(21) Appl. No.: 15/021,049

(22) PCT Filed: Aug. 27, 2014

(86) PCT No.: PCT/DE2014/100306
§ 371 (c)(1),
(2) Date: Mar. 10, 2016

(87) PCT Pub. No.: WO2015/035977
PCT Pub. Date: Mar. 19, 2015

(65) Prior Publication Data

US 2016/0225544 A1 Aug. 4, 2016

(30) Foreign Application Priority Data

Sep. 12, 2013 (DE) ..... 10 2013 015 174

(51) Int. Cl.
*H01H 1/04* (2006.01)
*H01H 1/40* (2006.01)
(Continued)

(52) U.S. Cl.
CPC ..... *H01H 1/04* (2013.01); *H01H 1/40* (2013.01); *H01H 3/02* (2013.01); *H01H 13/063* (2013.01); *H01H 13/36* (2013.01)

(58) Field of Classification Search
CPC .. H01H 1/04; H01H 1/40; H01H 3/02; H01H 13/063; H01H 13/36
(Continued)

(56) References Cited

U.S. PATENT DOCUMENTS 4,311,884 A * 1/1982 Henley ..... H01H 23/006 200/16 R
5,072,077 A * 12/1991 Klein ..... H01H 13/702 200/292
(Continued)

FOREIGN PATENT DOCUMENTS

CN 1842883 A 10/2006
CN 201145142 Y 11/2008
(Continued)

OTHER PUBLICATIONS

Machine Translation of Abstract for DE2359971A1 by Lexis Nexis Total Patent on Apr. 7, 2016.
(Continued)

*Primary Examiner* — Edwin A. Leon
(74) *Attorney, Agent, or Firm* — Woodard, Emhardt, Moriarty, McNett & Henry LLP

(57) ABSTRACT

Disclosed is a microswitch that allows the setting of the microswitch to be detected. The microswitch includes a conducting element movable along a surface that includes at least one conducting track that is contacted by the movable conducting element. Actuating the microswitch moves the movable conducting element along the surface resulting in electrically connecting or disconnecting two electrical tracks and causing electrical switching. In addition, the contact surfaces electrically connected by the conducting element may have different electrically conductive regions such that moving the connected surfaces changes the electrical resistances. Different switch positions can be determined by measuring resistance.

18 Claims, 3 Drawing Sheets

(51) Int. Cl.
*H01H 13/06* (2006.01)
*H01H 3/02* (2006.01)
*H01H 13/36* (2006.01)

(58) Field of Classification Search
USPC ..... 200/61.58 R, 5 A, 292, 512, 516, 301, 200/408
See application file for complete search history.

(56) References Cited

U.S. PATENT DOCUMENTS

| | | | | |
|---|---|---|---|---|
| 5,117,077 | A * | 5/1992 | Sakurada | H01H 13/48 200/301 |
| 6,359,242 | B1 * | 3/2002 | Maple | H01H 13/702 200/292 |
| 6,727,445 | B2 * | 4/2004 | Cullinan | H01H 3/141 200/5 A |
| 7,485,824 | B2 | 2/2009 | Rastemborski et al. | |
| 7,884,293 | B2 | 2/2011 | Ulomek | |
| 2013/0134026 | A1 * | 5/2013 | Boget | H01H 13/807 200/512 |

FOREIGN PATENT DOCUMENTS

| | | | |
|---|---|---|---|
| CN | 101454529 | A | 6/2009 |
| DE | 2359971 | A1 | 6/1975 |
| DE | 102004040395 | A1 | 3/2005 |
| DE | 102006024292 | A1 | 11/2007 |
| DE | 102006059275 | A1 | 6/2008 |
| DE | 102011089024 | A1 | 6/2013 |
| DE | 102012211756 | A1 | 1/2014 |
| EP | 0226705 | A2 | 7/1987 |
| EP | 2216796 | A1 | 8/2010 |
| WO | WO 2013071913 | A2 | 5/2013 |

OTHER PUBLICATIONS

Machine Translation of DE102004040395A1 by Lexis Nexis Total Patent on Apr. 7, 2016.
Machine Translation of DE102006024292A1 by Lexis Nexis Total Patent on Apr. 7, 2016.
Machine Translation of DE102006059275A1 by Lexis Nexis Total Patent on Apr. 7, 2016.
Machine Translation of DE102011089024A1 by Lexis Nexis Total Patent on Apr. 7, 2016.
Machine Translation of DE102012211756A1 by Lexis Nexis Total Patent on Apr. 7, 2016.
Machine Translation of WO2013071913A2 by Lexis Nexis Total Patent on Apr. 7, 2016.
Machine translation of CN201146142Y by Lexis Nexis Total Patent on Jan. 2, 2018.

* cited by examiner

MICROSWITCH FOR POSITION DETERMINATION, AND USE

BACKGROUND

The invention concerns a microswitch and an electronic component carrier, in particular for a motor vehicle with strip conductors embedded in an electrically insulating material, electrical connections and an integrated microswitch. Furthermore, the invention concerns advantageous use.

An electronic component carrier is a self-supporting component with a housing and electrical strip conductors inserted into the housing which have basically been stamped out of sheet metal. The inserted strip conductors are sprayed with insulating material and protected from environmental influences. The strip conductor material is so thick and thus stable that strip conductor ends can act as contact pins. Furthermore, the material is basically flexible in order that strip conductor ends can be bent in the desired direction for the purpose of contacting. In principle, the strip conductors are made of metal and are in particular 0.1 mm to 1 mm thick.

Electrical components are connected to the electrical connections of such a strip conductor unit, such as switches, detectors, electronic components or electric motors, for example. Such electrical components can be found for example in a latch, in particular a door latch of a motor vehicle.

In order to manufacture an electronic component carrier strip conductors are usually initially stamped out of sheet metal and if necessary additionally prepared by bending for example for the provision of contact lugs and/or drilling. The strip conductors thus prepared which can still demonstrate supporting and or connecting bridges are then inserted into a housing of the electronic component carrier. Insulating material is then sprayed in a first step for the purpose of fixing of the strip conductors into the housing. Then, connecting and/or supporting bridges—where available—are separated between strip conductors. Finally, the housing is filled in the envisaged way by the spraying of insulating material.

Contact lugs protrude from the insulating material in order to be connected, for example, with components such as a switch by soldering. The protruding contact lugs form the electrical connections of the electronic component carrier. Thus, for example, in accordance with the German patent registration 102012211756 a switch is inserted in the envisaged position so that its contacts can be soldered with the protruding contacts of the strip conductors.

A microswitch is an electrical switch with the contacts being a short distance apart in the open state. The distance is only several millimeters and only permits small electrical loads which can be switched. Small electrical loads in this sense can be found in motor vehicle latches.

It is known that a microswitch can be inserted into a motor vehicle in order to detect a state, thus for example the position of pivotable levers and catches in motor vehicle latches, the position of doors or flaps or the connection of a charging plug with a charging jack in vehicles which are operated with an electrical motor. The pivoting of a lever, a catch, a door, a flap or the placement of electrical plugs into an electrical jack activates a microswitch. An electrical switching thus triggered indicates the occurrence. An example is known from the publications DE 10 2006 059 275 A1 and WO 13071913 A2.

The publication DE 10 2011 089 024 A1 reveals a module with an electronic component carrier and a switching device. The switching device of the module is hereby formed by means of at least one contact area in each instance, at least two stamping grid conductors and a contactless magnetically relocatable switching medium of the module, by means of which contact areas of different stamping grid conductors are selectively bridgeable. The contact areas envisaged for the formation of switching functionality are located freely on a surface of the carrier and can thus be scanned or contacted from the switching medium on the carrier surface and hereby selectively bridged. Switching positions of the switching device can be detected.

The publication DE 10 2004 040 395 A1 reveals an electrical switch for a motor vehicle with two strip conductors and a switching contact arranged above the strip conductors in the form of a deformable snap dome. The switching contact is in constant electrical contact with one of the two strip conductors. Due to activation of the switch, the switching contact is deformed and thus electrically connected to the other strip conductor.

DE 10 2006 024 292 A1 reveals a handle for electrical activation of a seal on a flap or a door in a motor vehicle. A stamping grid is integrated into an electronic component carrier which acts as an insert in the housing shape in the injection molding manufacture of the dish-shaped handle housing. At its internal end, the electronic component carrier possesses a dish-type mounting which acts to insert a deformable snap dome. The snap dome is part of an electrical switch in order to electrically connect break contacts.

SUMMARY

Unless specified otherwise hereinafter, the aforementioned characteristics can be optionally combined individually or in any combination with the object of the invention described hereinafter.

It is the task of the invention to provide a further developed microswitch which also permits in particular detection of the position of the microswitch.

In order to solve the task, a microswitch is provided for which comprises a conductor element which can be shifted along a surface. At least one, preferably at least two strip conductors are integrated into the surface in such a way that these can be contacted by the shiftable conductor element. The shiftable conductor element is at least shifted in regions by activation of the microswitch. During shifting, the shiftable conductor element is adjacent to the surface along which the shiftable conductor element is shifted.

By shifting, two electrical strip conductors are electrically connected or an electrical connection between two strip conductors is interrupted. Shifting therefore causes electrical switching.

One or several conduct surfaces which are electrically connected via the shifting demonstrate areas of different electrical conductivities in such a way that electrical resistances of electrically connected surfaces change via the shifting. A multitude of different switch positions can then be detected by means of resistance measurements. If such a microswitch is used for position recognition, more than two different positions can thus be detected.

In particular, the shiftable conductor element is arch-shaped and elastically deformable. At least one end of the arch-shaped conductor element is adjacent on the surface into which one or several strip conductors are integrated. For shifting, the arch-shaped conductor element is elastically deformed in such a way that at least one end area, preferably the two end areas of the arch-shaped conductor element are shifted.

One end of the arch-shaped, elastically deformable conductor element can be durably electrically connected with an electrical conductor and/or firmly mounted. Upon activation of the microswitch only the other end is then shifted for electrical switching. However, for manufacturing reasons inter alia it is preferred that both ends—as described hereafter—are shifted by activation of the microswitch along a surface with integrated strip conductors. Such a microswitch can be of a very small construction and can nevertheless facilitate the detection of a multitude of positions.

A surface which contacts another surface by shifting of the conductor element demonstrates different metals or different metal alloys in one execution form. Thus, surface areas which are capable of mechanical resistance are provided with areas of different electrical conductivities.

In one design, the microswitch demonstrates more than two strip conductors which can be electrically contacted via shifting. As a result, different positions of the microswitch can be contacted in a further improved manner.

In one design of the invention which is technically simple to manufacture one or several surface areas of the shiftable conductor element which electrically contact the microswitch by shifting of an electrical conductor demonstrate surface areas of different electrical conductivities in particular due to different metals from which the surface areas are formed. All firmly mounted strip conductors of the microswitch can then be manufactured from a single piece of sheet metal by stamping which simplifies manufacture.

In one design of the invention the surface area which encompasses areas of different conductivities is provided by a contact battery. The contact battery is firmly connected to an electrical conductor or the conductor element which is shiftable at least in places, for example by soldering. This enables specific separate manufacture of the surface which demonstrates surface areas of different conductivities.

In one design, the surface areas of different conductivities run in a strip shape and vertically to the shifting direction of the conductor element which can be shifted at least in places. This design enables a multitude of positions of the microswitch to be detected with further improvement.

In one design of the invention, surface areas with good electrical conductivity are made of copper or silver. In contrast, in one design of the invention areas with poor conductivity are made of stainless steel, iron or brass or a metallic alloy as alloys are often poor electrical conductors in contrast to pure metals.

Furthermore, the invention relates to an electronic component carrier with a basic part made of electrically insulating material and electrical strip conductors for connection of electrical components whereby strip conductors are surrounded by the material of the basic part. At least two, preferably three electrical strip conductors of the electronic component carrier are a direct component of the electrical microswitch.

By means of this design, an electrical switch does not need to be soldered with protruding contacts of an electronic component carrier. Strip conductors which already comprise an electrical component carrier are a direct component of the electrical microswitch. The manufacturing cost is accordingly low. If at least three electrical strip conductors are a component of the switch, a multitude of positions of the switch can be simply detected with further improvement. The switch is very simple and thus robust and durable.

In an advantageous design of the invention four strip conductors are present which are a direct component of the switch. At rest, i.e. in the non-activated state of the switch, the arch-shaped conductor element advantageously contacts two internal strip conductors. Internal strip conductors are those which are situated between two further strip conductors of the microswitch. If the switch is activated, this causes the two internal strip conductors to no longer be electrically connected, but the two external strip conductors instead. This can be used, for example, for a detection of the position of the microswitch.

The strip conductor sections of the microswitch from which the arch-shaped conductor element can be contacted advantageously run parallel to one another in order to minimize the necessary installation space.

In one execution form, the microswitch encompasses a cap or a lid with a middle area and an adjacent area made of deformable plastic material. Upon activation of the microswitch the middle area transmits such force onto the arch-shaped conductor element that this is deformed in the pre-stated manner.

In one execution form of the invention, the areas of the strip conductors which can be contacted via the arch-shaped conductor element end flush with the adjacent surface and namely with those which at least are adjacent to the surface at the ends of the arch-shaped conductor element or on the ends of the arch-shaped conductor element by activation of the switch. Thus, the force which needs to be expended for activation of the switch is kept advantageously small.

In one execution form of the invention, the switch encompasses conductors and/or positioners in order to conduct and/or position the arch-shaped conductor element.

In one execution form of the invention, there is a pin protruding from the surface of the electronic component carrier which reaches through a hole in the arch-shaped conductor element. This positioner ensures in a technically simple manner that the arch-shaped conductor element retains its position relatively to the strip conductors.

In an advantageous execution form of the invention the two ends of the arch-shaped conductor element are conducted by adjacent bridges. Erroneous movements are thus prevented.

In one execution form of the invention, the ends of the arch-shaped conductor element are bent in the opposite direction to the other arch shape of the arch-shaped conductor element. Friction resistance which occurs during activation of the microswitch is thus kept low.

An electronic component carrier with the microswitch can and should be electrically connected to at least two further electrical components. This distinguishes an electronic component carrier from a microswitch which is not an integral component of an electronic component carrier. Examples of further components in terms of the present invention are one or several sensors or detectors, one or several motors, one or several further microswitches. In addition to the strip conductors which are a direct component of the integrated microswitch, the electronic component carrier demonstrates further strip conductors.

As the microswitch is compact, small and light and can be well protected from environmental influences, it is suited first and foremost to use in motor vehicles, in particular in order to determine a position of a component of the motor vehicle, for example a component of a motor vehicle latch or the position of a door, flap, jack or camera.

The following are shown:

DETAILED DESCRIPTION OF THE DRAWINGS

Figure 1:
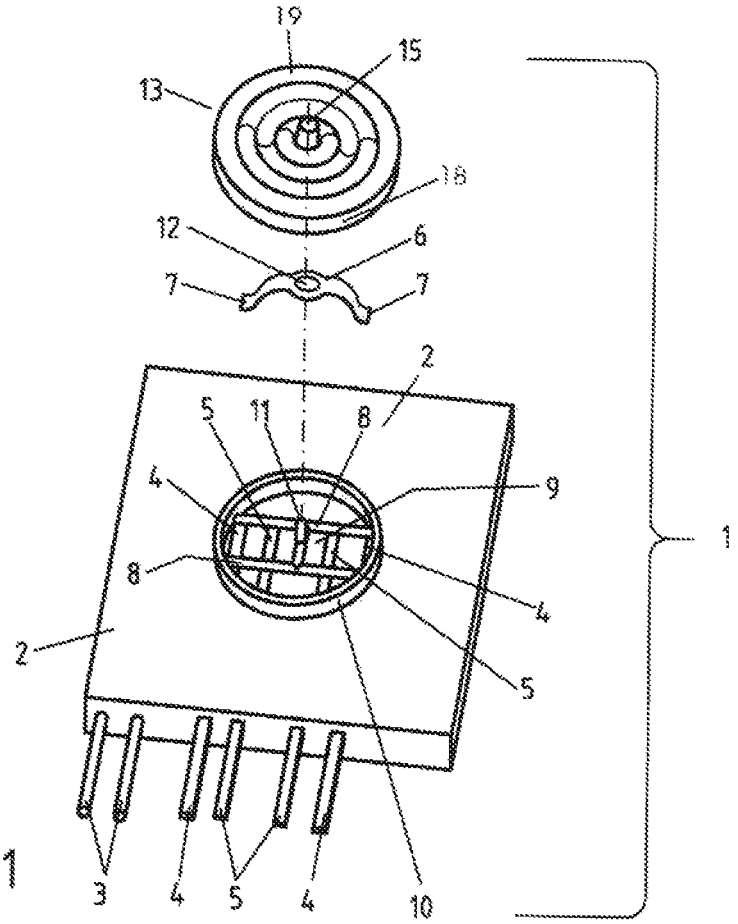
FIG. 1: Components of the electronic component carrier in the uninstalled state.
Figure 2:
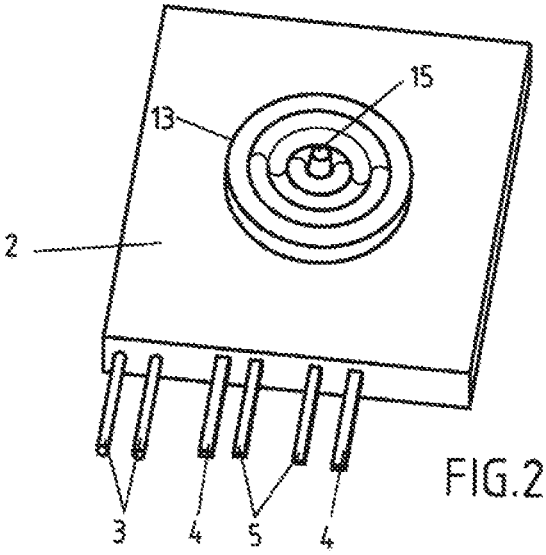
FIG. 2: Electronic component carrier
Figure 3:
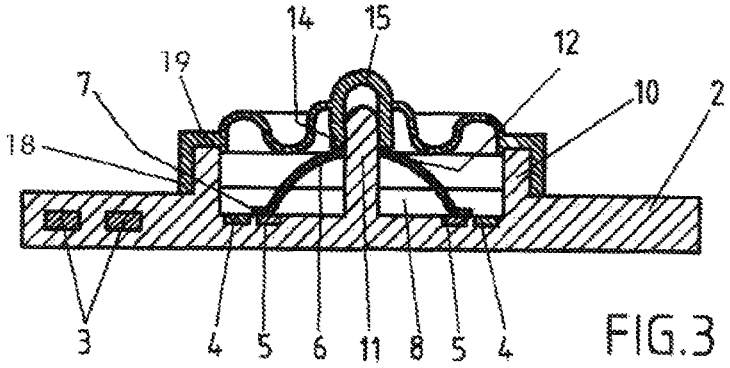
FIG. 3: Cross-section through the electronic component carrier in the non-activated state
Figure 4:
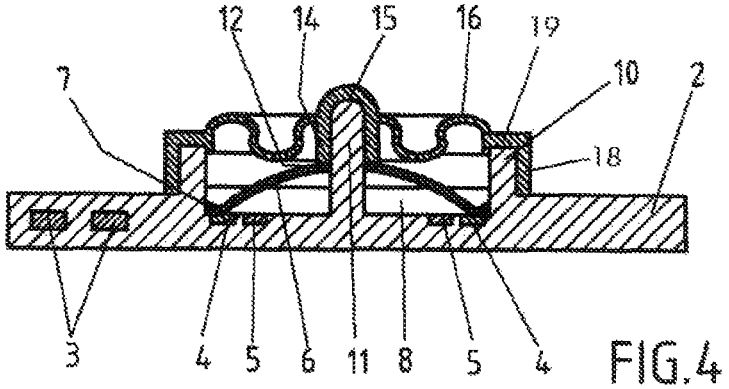
FIG. 4: Cross-section through the electronic component carrier in the activated state

FIGS. 1 to 4 illustrate the construction of a microswitch which is integrated into an electronic component carrier 1. The electronic component carrier comprises a basic section 2 made of electrically insulating material and electrical strip conductors 3, 4, 5. The basic section can be manufactured by plastic housing and material sprayed into the housing. The strip conductors 3, 4, 5 inserted into the housing before spraying are partly surrounded by the material of the basic section 2. Four electrical strip conductors 4, 5 of the electronic component carrier 1 are a direct component of an electrical microswitch. The microswitch comprises an arch-shaped conductor element 6 which is elastically deformable. By activation of the microswitch the arch-shaped conductor element 6 is elastically deformed in such a way that the two end areas 7 of the conductor element 6 are shifted. FIG. 4 shows a cross-section of the shifted and consequently the activated state. By means of the shifting of the two end areas 7 the two electrical strip conductors 4 are electrically connected. On the contrary, the electrical connection between the two strip conductors 5 is interrupted by activation.

When the switch 1 is at rest the arch-shaped conductor element 6 contacts the two internal strip conductors 5 with its end areas 7 as illustrated in FIG. 3. These internal strip conductors 5 are located between the two further strip conductors 4.

The end areas 7 demonstrate two different metals with different electrical conductivities on the surface which the strip conductors 5 contact in a strip shape. This leads to measurable changes in resistance during shifting. The changes in resistance enable further information on the position of the arch-shaped conductor element effected by the degree of depression of the cap 13.

The strip conductor sections of the microswitch arranged between the two bridges 8 and which can be contacted by the arch-shaped conductor element 6 run parallel to one another in order to minimize the necessary installation space. These sections or areas of the strip conductors 4, 5 arranged between the two bridges 8 and which can be contacted by the arch-shaped conductor element 6 end with their surface flush with the adjacent surface 9 of the insulating material. Furthermore, the surfaces of the strip conductors 4, 5 end flush with the adjacent surface insofar as these are arranged inside the protruding, ring-shaped edge 10.

There is a pin 11 protruding from the surface of the electronic component carrier 1 which reaches through the hole 12 in the arch-shaped conductor element 6 which act as positioners. The two ends 7 of the arch-shaped conductor element 6 are conducted through the laterally adjacent bridges 8.

The ends 7 of the arch-shaped conductor element 6 are bent in the opposite direction to the other arch shape of the arch-shaped conductor element 6. This creates arch-shaped contact areas for the end areas 7 whereby friction resistance which occurs during activation of the microswitch 1 is minimized.

The protruding edge 10 ensures the dust- and moisture-proof sealing of the lid 13. The lid 13 is deformable as illustrated in the comparison of FIG. 4 with FIG. 3.

The strip conductors 3 of the electronic component carrier are not part of the microswitch. These should be electrically connected to a further electrical component.

An internal edge 14 of the lid is adjacent on the arch-shaped conductor element 6. By depression of the lid 13 the arch-shaped conductor element 6 is depressed and the microswitch thus activated. An area 15 of the lid 13 is envisaged for the depression which stretches externally in a cylinder shape in the direction of the edge 14. The pin 11 stretches into the cylinder shape which simultaneously acts as a conductor of the lid 13. Viewed from the area 15 the lid 13 stretches in a wave shape (16) in a radial direction. This facilitates activation.

Figure 5:
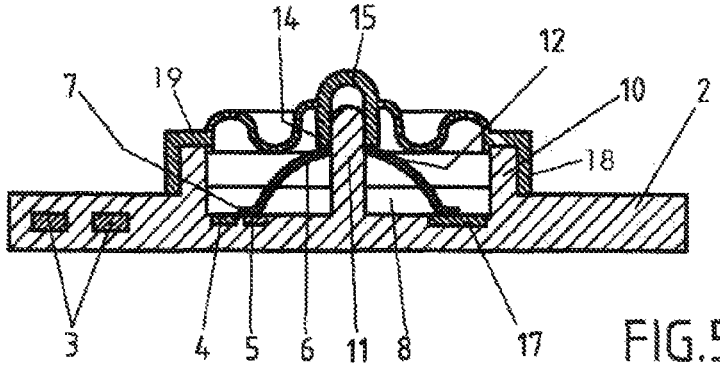
FIG. 5: Cross-section through the second electronic component carrier in the non-activated state
Figure 6:
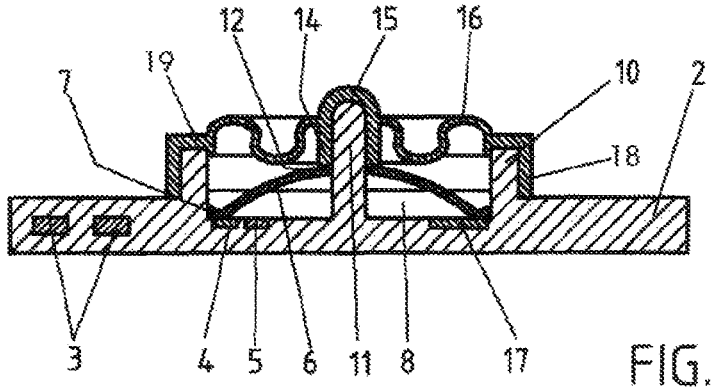
FIG. 6: Cross-section through the second electronic component carrier in the activated state

FIGS. 5 and 6 show an execution form of the invention with three strip conductors of the microswitch. The strip conductor 17 is wider than the strip conductors 4 and 5 so that a contact is always present for the arch-shaped conductor element 6. One of the two strip conductors 3 or 4 can be used to detect the position of the microswitch. But there is also the possibility of using both strip conductors 4 and 5 for switching.

Figure 7:
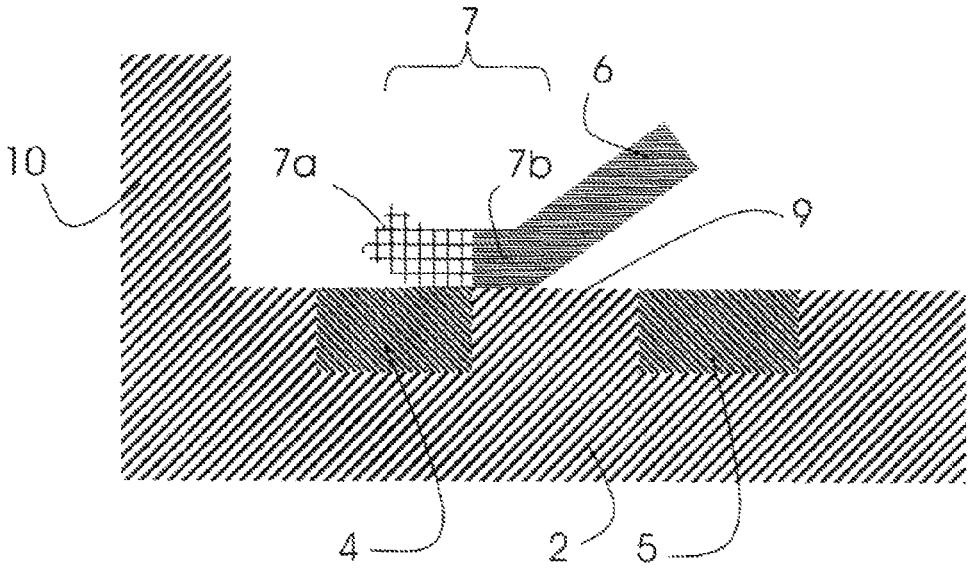
FIG. 7: Enlarged depiction of a section of a conductor end in a first position
Figure 8:
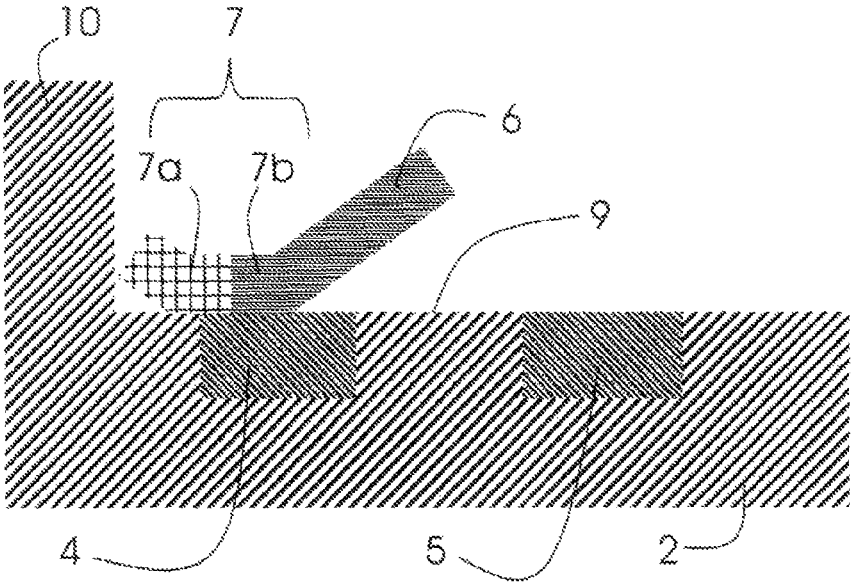
FIG. 8: Enlarged depiction of a section of a conductor end in a second position

FIGS. 7 and 8 illustrate the detection of two further positions of the arch-shaped conductor element 6 due to sections of the conductor element end 7 with varying degrees of conductivity. Section 7*a* consists of a material which is a poor conductor. Section 7*b* consists of a material which is a good conductor. Surfaces of the two sections 7*a* and 7*b* which can contact strip conductors 4 and 5 run in a strip shape vertically to the direction of movement of the end 7. In the case of FIG. 7 only the comparatively poorly conducting section 7*a* contacts the electrical strip conductor 4. Although there is now an electrically conducting connection. However, the Ohm resistance is relatively high. The measurement of this resistance indicates the position of the microswitch shown in FIG. 7. If the middle activation area 15 cap 13 is pressed further in the direction of the electronic component carrier, the section 7*b* with good conductivity contacts the electrical strip conductor. The electrical resistance decreases and thus displays that the position shown in FIG. 8 is attained.

This can be used, for example, to detect the position of a pivotable catch in a motor vehicle latch which can be ratcheted by means of one or several pawls in one pre-ratchet position and in one main ratchet position. If the end 7 contacts the strip conductor 4 the catch is in an opening position. If the end 7 reaches the position shown in FIG. 7 the catch is located in the pre-ratchet position. If the catch reaches the position shown in FIG. 8, the catch has reached the main ratchet position. If there is no electrically conducting contact, the catch is located in an intermediate position during opening or closure. A multitude of positions can thus be detected with only a compactly constructed microswitch.

It is sufficient if one end 7 demonstrates sections of different conductivities. However, it is preferable for both ends 7 to have sections 7*a* and 7*b* with different conductivities. Changes in resistance can thus be either increased in order to facilitate measurement. But it is also possible to increase variation options. Instead of the ends 7 or in addition strip conductors 4, 5, 17 can be equipped with sections of different conductivities in order to increase detection possibilities, for example.

REFERENCE LIST

1 Electronic component carrier
2 Basic section
3, 4, 5 Electrical strip conductor
6 Arch-shaped conductor element
7 Conductor element end
7*a* Section of the conductor element end with poor conductivity
7*b* Section of the conductor element end with good conductivity
8 Bridge
9 Surface
10 Ring-shaped edge
11 Pin
12 Hole in the arch-shaped conductor element
13 Lid
14 Internal edge of the lid
15 Activation area
16 Wave-shaped progression
17 Strip conductor
18 Ring-shaped edge of lid
19 Ring-shaped lid area

The invention claimed is:

1. Microswitch with at least one strip conductor which is integrated into a first surface whereby the microswitch encompasses an arch-shaped conductor element which is elastically deformable and shiftable along a second surface which can be shifted by activation of the microswitch, wherein the conductor element comprises two end areas and the conductor element is deformable in such a way that the two end areas of the conductor element are shifted relative to the second surface, whereby the shifting can induce electrical switching, whereby a contact surface which as a result of the shifting enables electrical switching by means of production of an electrical contact, demonstrates sections with different electrical conductivities.

2. Microswitch in accordance with claim 1, characterized in that the second surface which contacts the first surface by shifting of the conductor element encompasses different metals and/or different metal alloys.

3. Microswitch in accordance with claim 2, characterized in that the deformable conductor element demonstrates sections with different electrical conductivities.

4. Microswitch in accordance with claim 3, characterized in that the sections different conductivities are arranged in a strip shape vertically to the shifting direction of the shiftable conductor element.

5. Microswitch in accordance with claim 4, characterized in that the deformable conductor element contacts two internal strip conductors in the non-activated state of the microswitch which are arranged between two further strip conductors.

6. Microswitch in accordance with claim 1, characterized in that the areas of one or several strip conductors which can be contacted by means of the deformable conductor element end flush with an adjacent surface.

7. Microswitch in accordance with claim 1, characterized in that the microswitch encompasses conductors and/or positioners in order to conduct and/or position the deformable conductor element.

8. Microswitch in accordance with claim 5, characterized in that there is a pin protruding from an internal surface of the microswitch which reaches through a hole in the deformable conductor element.

9. Microswitch in accordance with claim 1, characterized in that two ends of the conductor element are conducted through adjacent bridges.

10. Electronic component carrier with a basic section made of electrically insulating material and electrical strip conductors for connection of electrical components, whereby strip conductors are surrounded by the material of the basic section at least in places and at least one, preferably at least two of the electrical strip conductors of the electronic component carrier are a direct component of an electrical microswitch which encompasses the characteristics in accordance with claim 1.

11. Use of a microswitch or electronic component carrier in accordance with claim 1 for the position determination of a component of a motor vehicle.

12. Microswitch in accordance with claim 1, characterized in that the microswitch encompasses positioners in order to position the deformable conductor element.

13. Microswitch in accordance with claim 1, characterized in that the deformable conductor element demonstrates sections with different electrical conductivities.

14. Microswitch in accordance with claim 1, characterized in that the sections of different conductivities are arranged in a strip shape vertically to the shifting direction of the shiftable conductor element.

15. Microswitch in accordance with claim 1, characterized in that the deformable conductor element contacts two internal strip conductors in the non-activated state of the microswitch which are arranged between two further strip conductors.

16. Microswitch in accordance with claim 1, characterized in that there is a pin protruding from an internal surface of the microswitch which reaches through a hole in the deformable conductor element.

17. Microswitch in accordance with claim 1, wherein, when shifting the conductor element along the second surface, the two end areas of the conductor element move in opposite directions.

18. Microswitch in accordance with claim 1, wherein shifting the conductor element along the second surface moves a first end area of the conductor element from a first position of the second surface to a second position of the second surface and moves a second end area of the conductor element from a third position of the second surface to a fourth position of the second surface.

* * * * *